US010312626B2

(12) United States Patent
Vasbinder et al.

(10) Patent No.: US 10,312,626 B2
(45) Date of Patent: Jun. 4, 2019

(54) ELECTRICAL CONNECTOR WITH TERMINAL ALIGNMENT PLATE AND SECONDARY LOCK DETECTION

(71) Applicant: TE CONNECTIVITY CORPORATION, Berwyn, PA (US)

(72) Inventors: Andrew Jacob Vasbinder, Bioling Springs, PA (US); Matthew Bryan Hitchcock, Lebanon, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/983,710

(22) Filed: May 18, 2018

(65) Prior Publication Data

US 2019/0006782 A1 Jan. 3, 2019

Related U.S. Application Data

(60) Provisional application No. 62/527,615, filed on Jun. 30, 2017.

(51) Int. Cl.

| | |
|---|---|
| ***H01R 13/514*** | (2006.01) |
| ***H01R 13/453*** | (2006.01) |
| ***H01R 43/18*** | (2006.01) |
| ***H01R 13/436*** | (2006.01) |
| ***H01R 13/631*** | (2006.01) |

(52) U.S. Cl.

CPC ..... *H01R 13/4538* (2013.01); *H01R 13/4362* (2013.01); *H01R 13/631* (2013.01); *H01R 43/18* (2013.01)

(58) Field of Classification Search

CPC ..... H01R 13/62938; H01R 13/4223; H01R 13/514; H01R 13/4362

USPC ..... 439/157, 595, 701, 752

See application file for complete search history.

(56) References Cited

U.S. PATENT DOCUMENTS 5,167,534 A * 12/1992 Ohsumi ..... H01R 13/4362 439/595
5,558,526 A 9/1996 Nagamine
5,782,657 A * 7/1998 Wolla ..... H01R 13/4362 439/595
6,305,990 B1 10/2001 Ward (Continued)

OTHER PUBLICATIONS

International Search Report, International Application No. PCT/IB2018/054584, European Filing dated Jun. 21, 2018.

*Primary Examiner* — Thanh Tam T Le

(57) ABSTRACT

An electrical connector assembly having a housing, a terminal alignment plate and an independent secondary lock member. The terminal alignment plate has secondary lock engagement surfaces. The independent secondary lock member has terminal alignment plate engagement surfaces. When the independent secondary lock member is in the open position, the terminal alignment plate engagement surfaces engage the secondary lock engagement surfaces of the terminal alignment plate to retain the terminal alignment plate in the protecting position and prevent the terminal alignment plate from being moved to the fully inserted position. When the independent secondary lock member is in the closed position, the terminal alignment plate engagement surfaces do not engage the secondary lock engagement surfaces of the terminal alignment plate, allowing the terminal alignment plate to be moved to the fully inserted position.

18 Claims, 7 Drawing Sheets

(56) References Cited

U.S. PATENT DOCUMENTS

| | | | | |
|---|---|---|---|---|
| 6,361,378 | B1 * | 3/2002 | Konoya | H01R 13/4364 439/595 |
| 6,866,552 | B2 | 3/2005 | Koehler | |
| 6,896,531 | B2 * | 5/2005 | Bakker | H01R 13/4538 439/140 |
| 7,500,887 | B2 * | 3/2009 | Ichio | H01R 13/4362 439/595 |
| 7,544,072 | B2 | 6/2009 | Rubenstein et al. | |
| 8,075,351 | B2 * | 12/2011 | Park | H01R 13/40 439/372 |
| 8,435,051 | B2 | 5/2013 | Tonosaki | |
| 8,469,752 | B2 * | 6/2013 | Park | H01R 13/506 439/752 |
| 8,979,560 | B2 * | 3/2015 | Kobayashi | H01R 13/62933 439/157 |
| 9,153,894 | B2 * | 10/2015 | Gerwatowski | H01R 13/4223 |
| 9,472,884 | B2 * | 10/2016 | Kutsuna | H01R 13/4362 |
| 2015/0133002 | A1 | 5/2015 | Gerwatowski | |

* cited by examiner

ELECTRICAL CONNECTOR WITH TERMINAL ALIGNMENT PLATE AND SECONDARY LOCK DETECTION

FIELD OF THE INVENTION

The invention is directed to an electrical connector assembly with a terminal alignment plate and a secondary lock detection member. In particular, the invention is directed to an electrical connector assembly in which the alignment plate is prevented from moving to a final position when the secondary lock detection member is in a shipping position.

BACKGROUND OF THE INVENTION

Electrical connectors may be used to transfer data and/or electrical power between different systems or devices. Electrical connectors are often designed to operate in challenging environments where contaminants, shock and/or vibration can disrupt the electrical connection. For example, automobiles and other machinery utilize electrical connectors to communicate data and/or electrical power therein. At least some known electrical connectors include a connector housing that has a cavity configured to receive another electrical connector (hereinafter referred to as a "mating connector"). The cavity opens to a front end of the connector housing and extends a depth into the connector housing. The electrical connector includes an array of electrical contacts, and the mating connector includes a complementary array of electrical contacts (hereinafter referred to as "mating contacts"). As the mating connector is received within the cavity, the electrical contacts are received within corresponding socket openings of the mating connector. Each socket opening may include one of the mating contacts that engages the corresponding electrical contact to establish an electrical connection.

Many times harnesses must be assembled and/or preassembled, where one part of the connector is not mated with the corresponding connector until sometime further in the overall assembly process. Thus, this requires a great deal of care for socket connectors of the type having a header and a plurality of upstanding tabs and/or pins.

Although the connector housing partially surrounds the electrical contacts within the receiving cavity, the electrical contacts may be exposed to the ambient environment through the open front end. During shipping or handling of the electrical connectors, contaminants may enter the receiving cavity through the front end. In addition, the front end may permit objects to enter the receiving cavity and engage the electrical contacts thereby moving and/or bending the electrical contacts. If an electrical contact is not positioned properly within the receiving cavity, the electrical contact may improperly engage the mating connector, an incident referred to as stubbing, which can damage the electrical contact. In some cases, the damage may require the electrical contact or, potentially, the entire electrical connector to be replaced.

In some connection systems, the headers are provided with freestanding pins without any type of support surrounding the pins. In other connection systems, alignment plates may be provided. Such alignment plates have a plurality of holes for receiving the terminal pin portions to maintain the alignment and spacing of the pin portions and prevent bending thereof or damage thereto. The alignment plates may be removed or remain in place before the connector is mated, or it has been known to provide an arrangement whereby the alignment plate moves from an outer protecting position, inwardly along the pin portions to an inner mating position, such as during insertion of the pin portions into holes in a printed circuit board.

Although alignment plates can be effective, alignment plates can easily be moved during shipping from an initial position, in which the terminal pins are protected, to a final position, in which the terminal pins are not protected. It would, therefore, be beneficial to provide a terminal alignment plate which cannot be easily moved to a final position during shipping. In particular, it would be beneficial to provide an electrical connector assembly in which the alignment plate is prevented from moving to a final position when a secondary lock detection member is in a shipping position.

SUMMARY OF THE INVENTION

An embodiment is directed to an electrical connector assembly having a housing, a terminal alignment plate and an independent secondary lock member. The housing has a plurality of terminals mounted in the housing with mating portions projecting therefrom. The terminal alignment plate has a plurality of terminal alignment plate apertures for receiving the mating portions of the terminals. The terminal alignment plate has secondary lock engagement surfaces. The terminal alignment plate is movably mounted on the housing between a protecting position in which the terminal alignment plate is positioned proximate distal ends of the terminals and a fully inserted position in which the terminal alignment plate is positioned away from the distal ends of the terminals. The independent secondary lock member has terminal alignment plate engagement surfaces. The independent secondary lock member being movably mounted on the housing between an open position and a closed position in which the independent secondary lock member engages a primary lock and secures the terminals in the housing. When the independent secondary lock member is in the open position, the terminal alignment plate engagement surfaces engage the secondary lock engagement surfaces of the terminal alignment plate to retain the terminal alignment plate in the protecting position and prevent the terminal alignment plate from being moved to the fully inserted position. When the independent secondary lock member is in the closed position, the terminal alignment plate engagement surfaces do not engage the secondary lock engagement surfaces of the terminal alignment plate, allowing the terminal alignment plate to be moved to the fully inserted position.

An embodiment is directed to an electrical connector assembly having a housing with a plurality of terminals mounted in the housing with mating portions projecting therefrom. The housing has recesses for receiving portions of a terminal alignment member. The terminal alignment member has a plurality of terminal alignment member apertures for receiving the mating portions of the terminals. The terminal alignment member has movable member engagement surfaces. The movable member engagement surfaces are positioned in the recesses of the housing. The terminal alignment member is movably mounted on the housing between a protecting position in which the terminal alignment member is positioned proximate distal ends of the terminals and a fully inserted position in which the terminal alignment member is positioned away from the distal ends of the terminals. A movable member is provided and has terminal alignment member engagement surfaces. The movable member is movably mounted on the housing between a first position and a second position. The terminal alignment member engagement surfaces are positioned in the recesses of the housing when the movable member is in the first position. The terminal alignment member engagement surfaces are positioned outside of the recesses of the housing when the movable member is in the second position. When the movable member is in the first position, the terminal alignment member engagement surfaces engage the movable member engagement surfaces of the terminal alignment member to retain the terminal alignment member in the protecting position and prevent the terminal alignment member from being moved to the fully inserted position.

An embodiment is directed to a method of mating an electrical connector assembly to a mating connector. The method includes: positioning an independent secondary locking member in a first position; positioning a terminal alignment member in a protecting position in which secondary lock engagement surfaces of the terminal alignment member engage terminal alignment plate engagement surfaces of the independent secondary lock member, wherein the terminal alignment member is prevented from being moved from the protecting position to a fully inserted position; moving the independent secondary locking member to a second position in which the terminal alignment plate engagement surfaces of the independent secondary lock member do not engage the secondary lock engagement surfaces of the terminal alignment member, allowing the terminal alignment member to be moved from the protecting position; and moving the terminal alignment member to a fully inserted position.

The method may also include engaging a projection of the independent secondary locking member which extends through the terminal alignment member to move the independent secondary locking member from the first position to the second position; positioning a mating connector in line with the connector assembly; or preventing the insertion of the mating connector into the connector assembly when the mating connector is not in condition for mating, wherein mating connector engaging surfaces of the terminal alignment member engage a portion of a mating connector to prevent the insertion of the mating connector into the electrical connector assembly.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
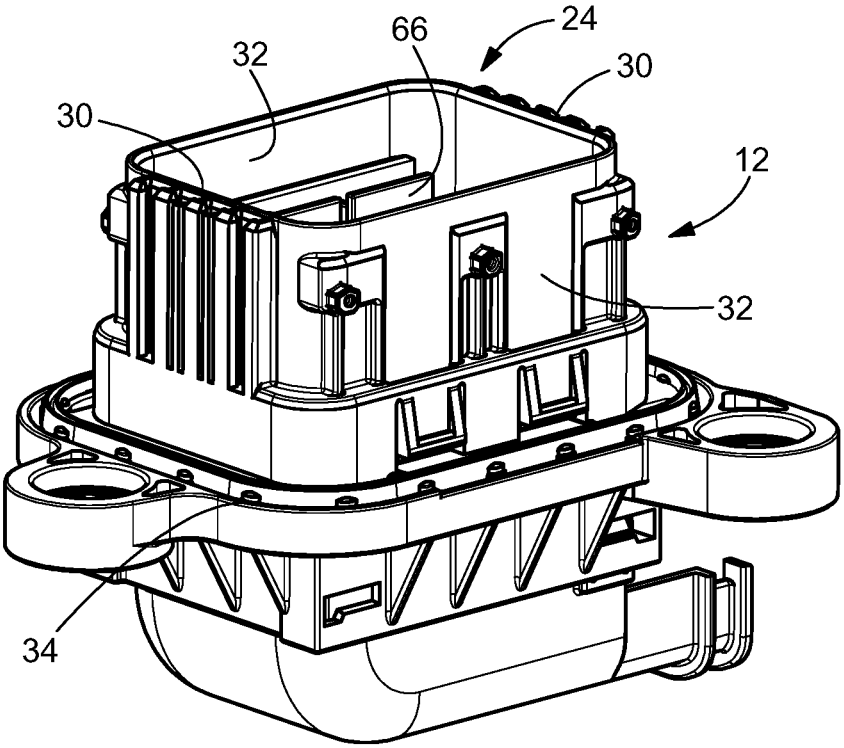
FIG. 1 is a perspective view of an illustrative electrical connector header assembly of the present invention, with a terminal alignment plate shown in shipping position.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features, the scope of the invention being defined by the claims appended hereto.

Figure 3:
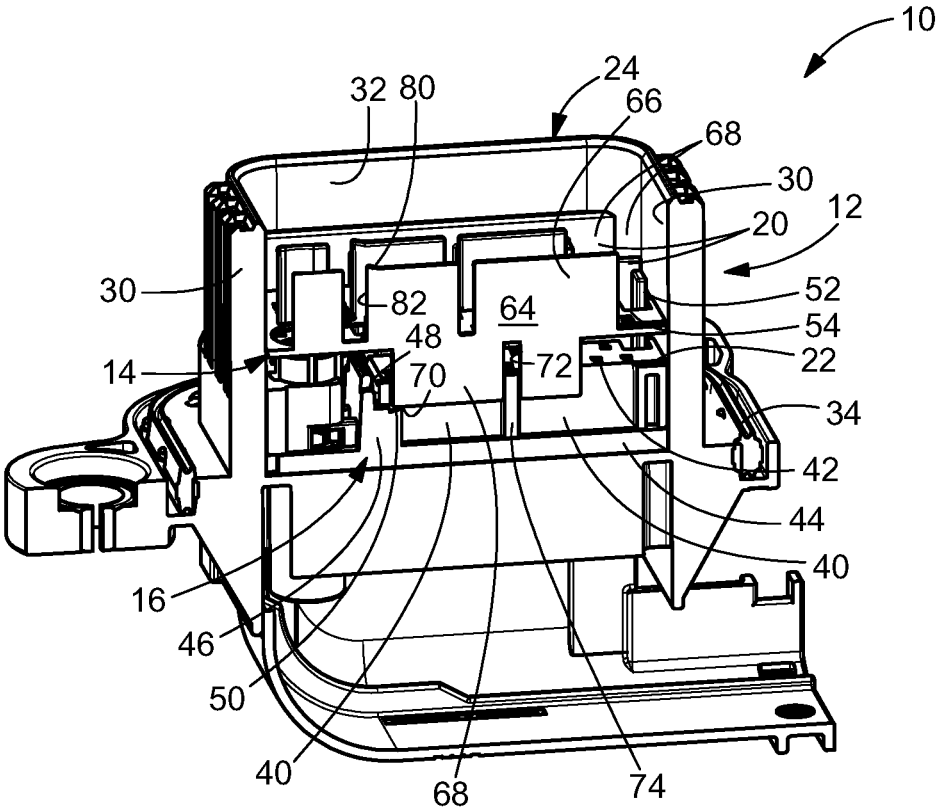
FIG. 3 is a perspective cross-sectional view of the header assembly of FIG. 1 taken along line 3-3 of FIG. 1, the terminal alignment plate and an independent secondary lock member are shown in a first or shipping position.
Figure 4:
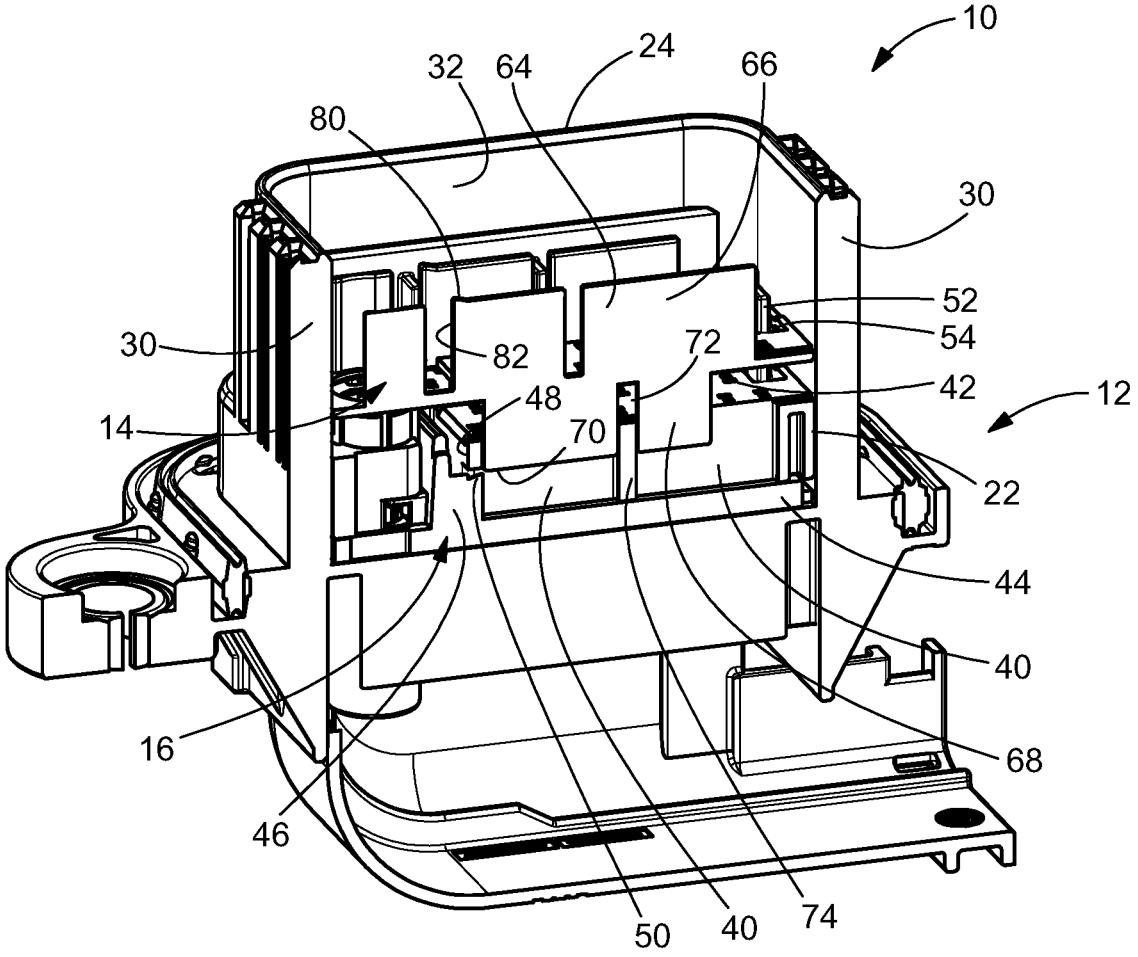
FIG. 4 is a perspective cross-sectional view of the header assembly similar to FIG. 3, except the independent secondary lock member is shown in a second or locked position, the terminal alignment plate remains in the first or shipping position.
Figure 5:
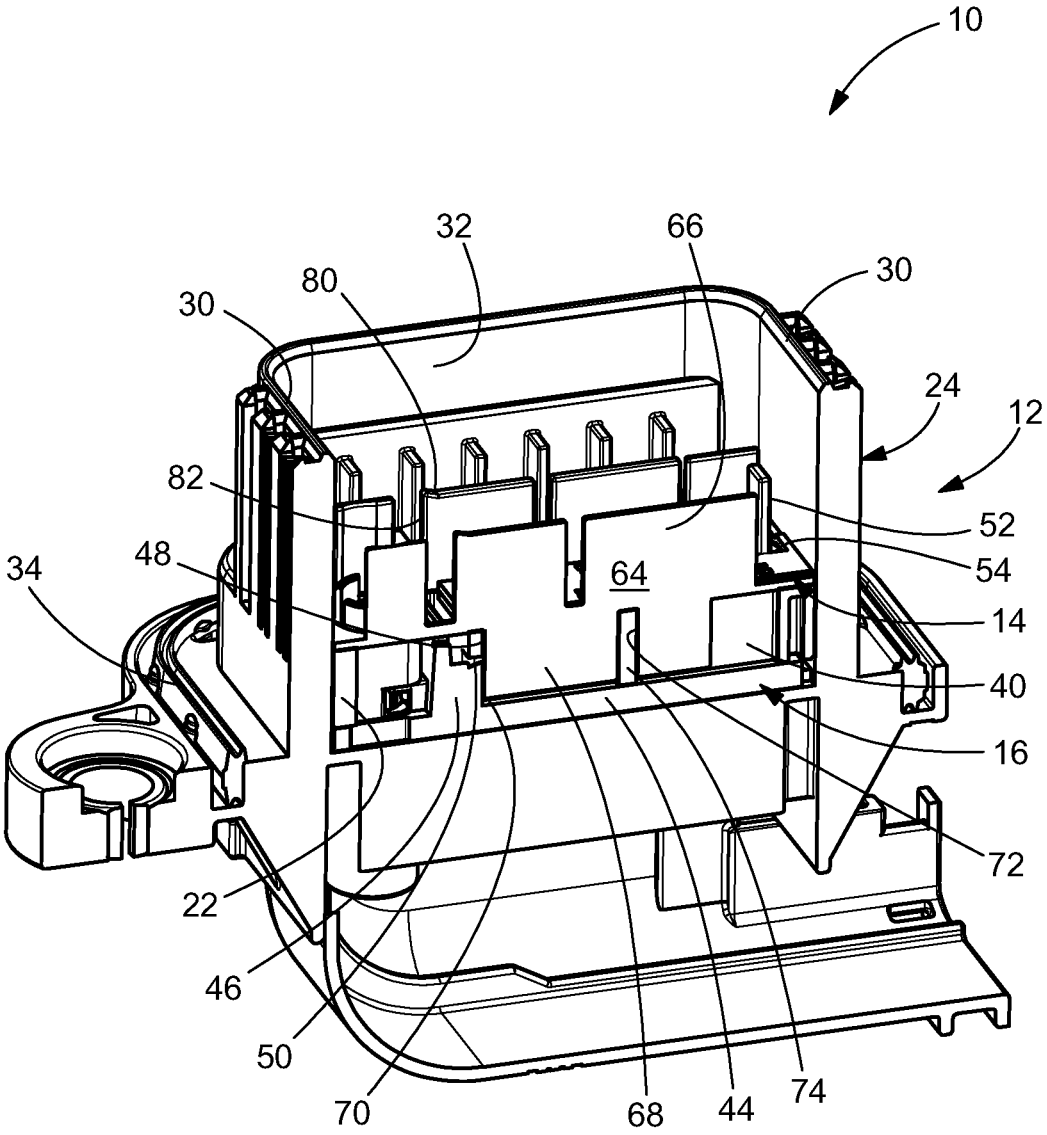
FIG. 5 is a perspective cross-sectional view of the header assembly similar to FIG. 3, except the terminal alignment plate is shown in a second or fully inserted position and the independent secondary lock member is shown in a second or locked position.

As best shown in FIGS. 3 through 5, a header assembly 10 includes a housing 12, a pin or terminal alignment member or plate 14 and a movable member, such as a secondary lock member 16. Contacts or terminals 20 are provided in the housing. The contacts or terminals 20 may be pin contacts, tabs or other known types of contacts.

The housing 12 generally includes a terminal receiving portion 22 with a shroud 24 extending therefrom. The shroud 24 has end walls 30 and side walls 32. The housing 12 further includes a lower flange portion 34, which circumscribes the housing 12.

As best shown in FIGS. 1 through 5, the terminal receiving portion 22 has alignment plate receiving recesses 40 which extend through at least a portion of the terminal receiving portion 22. Terminal receiving openings 42 (FIGS. 3 and 4) also extend through the terminal receiving portion 22. It should be appreciated that the terminal receiving openings 42 are profiled according to the particular contacts or terminals 20 positioned in the housing 12.

The independent secondary locking member 16 is positioned proximate the terminal receiving portion 22. The independent secondary lock 16 helps to ensure the terminals remain properly positioned within the housing. The independent secondary lock member 16 also cooperates with the primary lock (not shown) to prevent withdrawal of the terminals from the connector. In the illustrative embodiment shown, the independent secondary lock member 16 includes a planar member 44 which extends across a bottom surface of the terminal receiving portion 22. A projection or rib 46 extends upward from the terminal receiving portion 22 toward the shroud 24. The projection or rib 46 extends into a cavity 48 in the terminal receiving portion 22. The rib 46 has one or more terminal alignment plates or terminal alignment member engagement surfaces 50. In the embodiment shown, the terminal alignment plates or member engagement surfaces 50 extend at an angle relative to the longitudinal axis of the rib 46. However, other configurations of the terminal alignment plates or member engagement surfaces 50 may be used.

An engagement projection 52 (such as, but not limited to a rib or tower) extends upward from the terminal receiving portion 22 toward the shroud 24. The engagement projection 52 extends through an opening 54 in the terminal receiving portion 22, such that a free end of the engagement projection 52 is positioned above a top surface of the terminal receiving portion 22.

Figure 2:
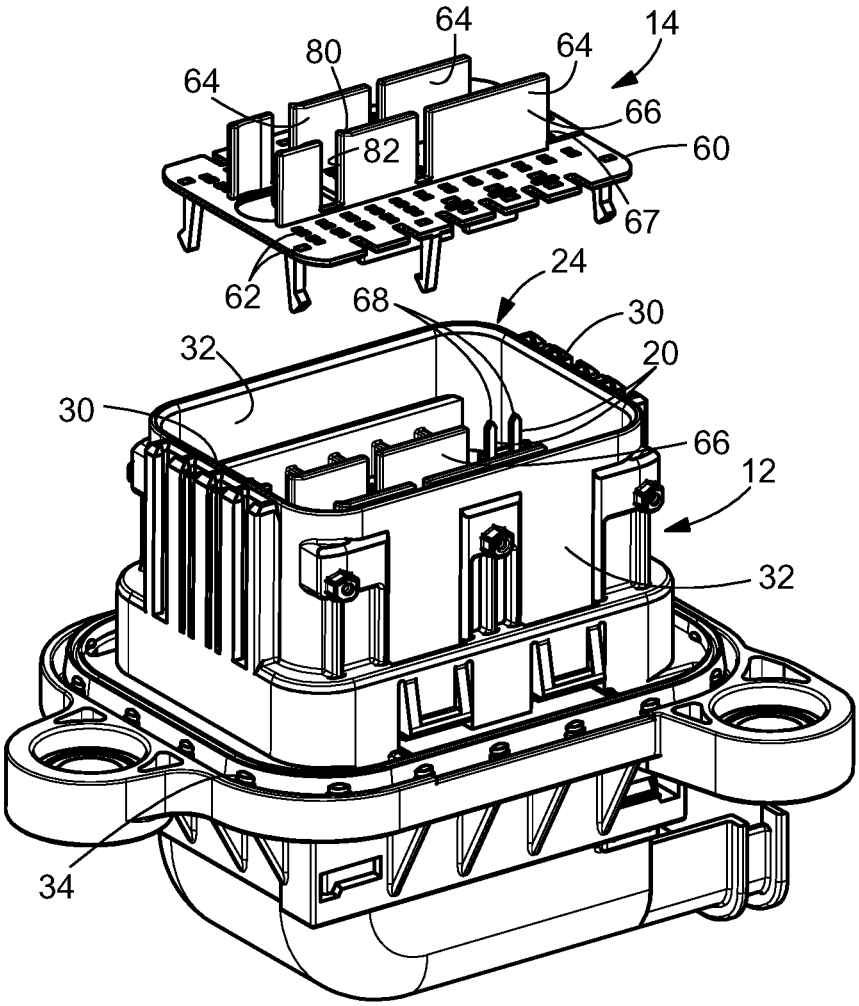
FIG. 2 is an exploded perspective view of the header of FIG. 1, with the terminal alignment plate exploded therefrom.

As best shown in FIG. 2, the alignment plate 14 includes a plate portion 60 with a plurality of terminal receiving openings 62 extending therethrough. Projections or walls 64 extend from the terminal receiving portion 22. Each wall 64 has an upwardly extending portions 66 which extends in a direction toward a mating end 68 of the terminals 20. Each wall 64 also has an oppositely or downwardly extending portion 68 which extends towards and cooperates with the recesses 40 of the terminal receiving portion 22. A projection receiving opening 67 is provided in the plate portion 60.

The downwardly extending portion 68 has one or more secondary lock engagement surfaces 70. In the embodiment shown, the secondary lock engagement surfaces 70 extend at approximately a 90 degree angle relative to the longitudinal axis of the rib 46. However, other configurations of the secondary lock engagement surfaces 70 may be used. The downwardly extending portion 68 has one or more recesses or slots 72 which cooperate with projections 74 of the terminal receiving portion 22 which extend into the alignment plate receiving recesses 40.

The upwardly extending portion 66 has one or more mating connector engagement surfaces 80. In the embodiment shown, the mating connector engagement surfaces 80 extend approximately parallel to the secondary lock engagement surfaces 70. However, other configurations of the mating connector engagement surfaces 80 may be used. The downwardly extending portion 68 has on or more recesses or slots 82 which cooperate with projections 84 of the mating connector 18.

Figure 6:
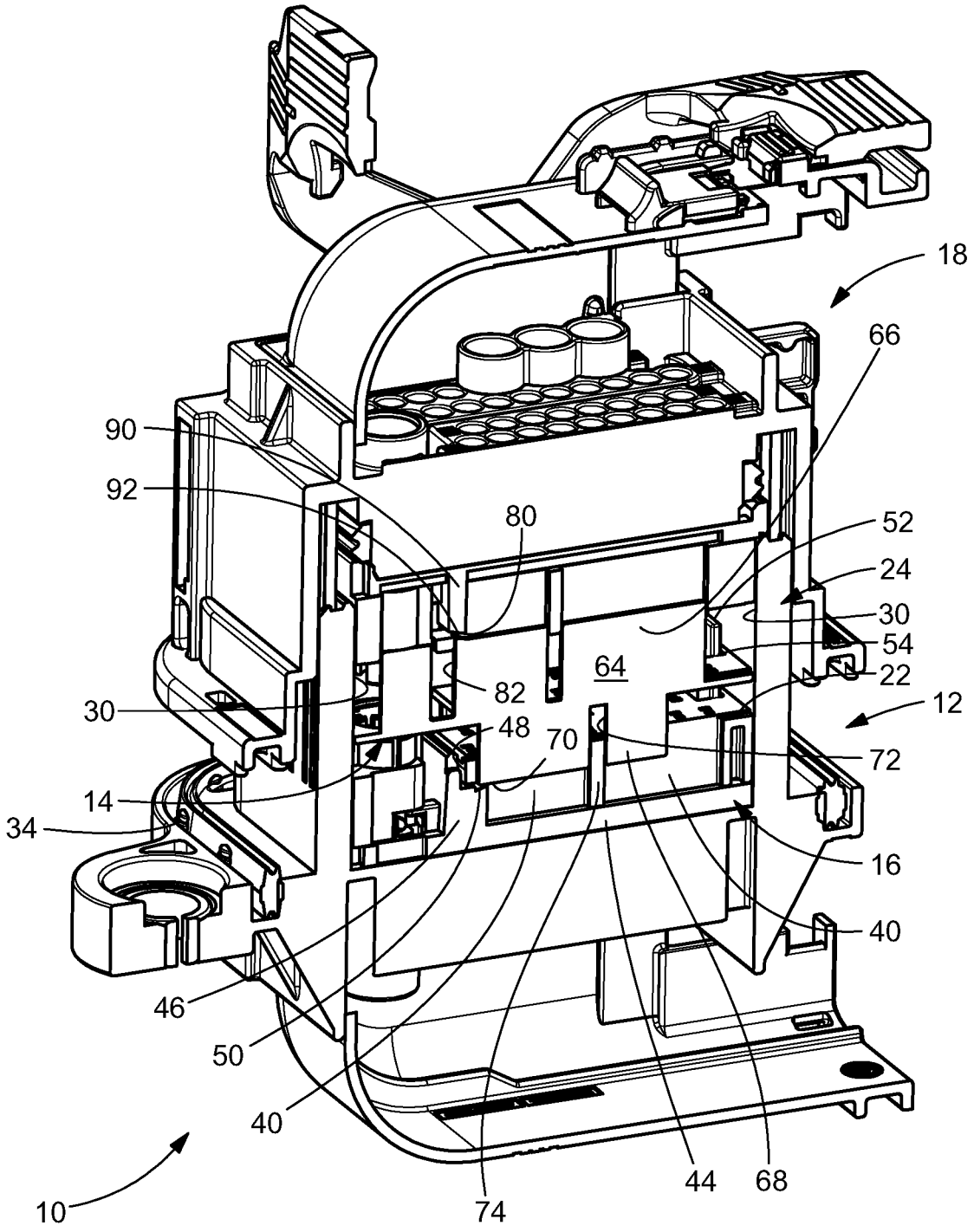
FIG. 6 is a perspective cross-sectional view of the header assembly of FIG. 1 with a mating connector positioned proximate the header assembly, the terminal alignment plate of the header assembly and the independent secondary lock member of the header assembly are shown in a first or shipping position, an independent secondary lock member of the mating connector is shown in a first position.
Figure 7:
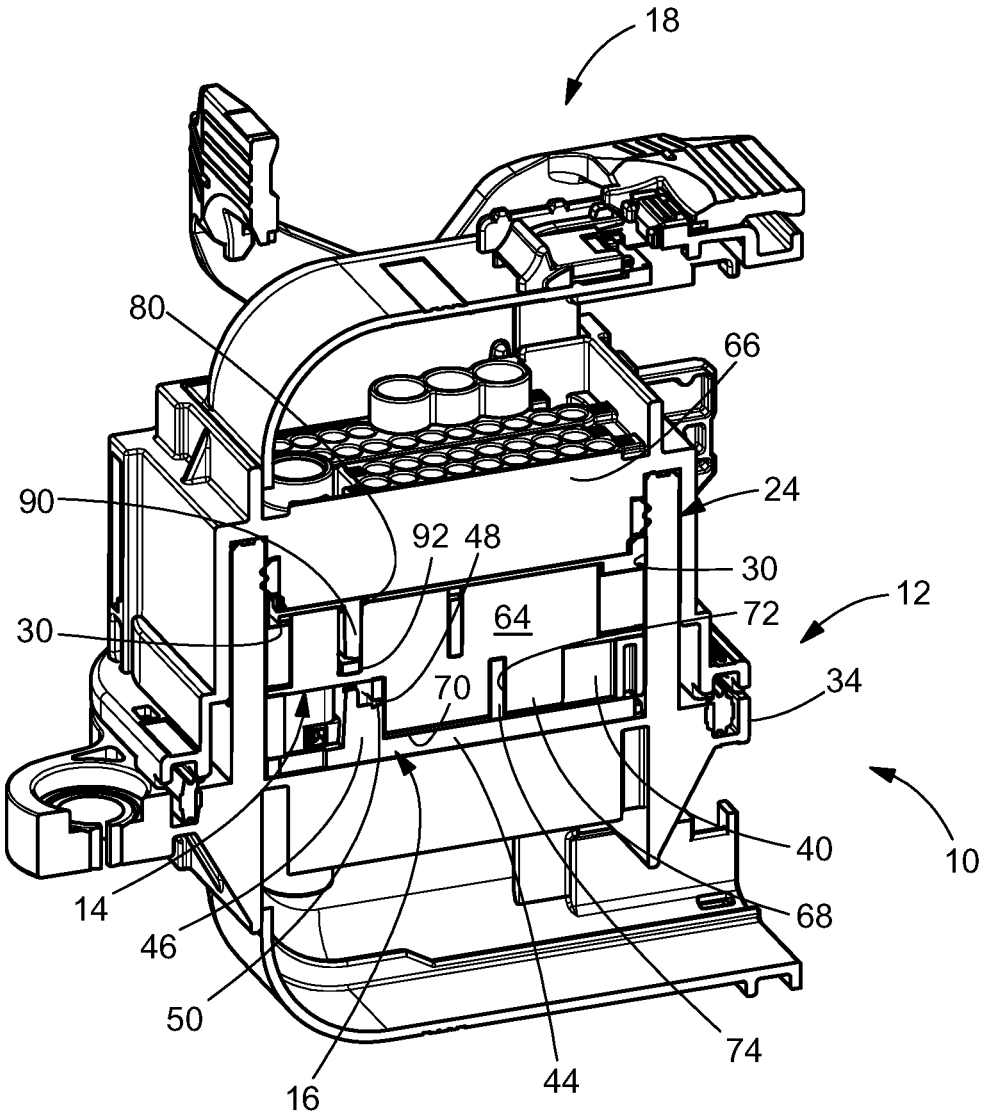
FIG. 7 is a perspective cross-sectional view of the header assembly of FIG. 1 with the mating connector fully mated to the header assembly, the terminal alignment plate of the header assembly is shown in a second or fully inserted position, the independent secondary lock member of the header assembly is shown in a second or locked position, and the independent secondary lock member of the mating connector is shown in a second or locked position.

As best shown in FIGS. 6 and 7, the mating connector 18 has a projection or rib 90 which extends from the mating face. The rib 90 has one or more terminal alignment plates or terminal alignment member engagement surfaces 92. In the embodiment shown, the terminal alignment plates or member engagement surfaces 92 extend at an angle relative to the longitudinal axis of the rib 90. However, other configurations of the terminal alignment plates or member engagement surfaces 92 may be used.

Referring to FIG. 3, the terminal alignment member 14 is shown in a first, protecting, pre-stage or shipping position. In this position, the plate portion 60 of the terminal alignment member 14 is positioned proximate the mating or distal ends 68 of the terminals 20. Portions of the downwardly extending portions 68 of the walls 64 of the terminal alignment member 14, including the secondary lock engagement surfaces 70, are positioned in the alignment plate receiving recesses 40 of the terminal receiving portion 22 of the housing 12. The slots 72 of the downwardly extending portions 68 cooperate with the projections 74 to maintain the terminal alignment member 14 in a stable position relative to the housing 12.

In the position shown in FIG. 3, the independent secondary lock member or movable member 16 is also positioned in an open or first position. In this position, the terminal alignment plates or terminal alignment member engagement surfaces 50 are positioned in the alignment plate receiving recesses 40.

In the position shown in FIG. 3, the terminal alignment plates or terminal alignment member engagement surfaces 50 are positioned in-line and in engagement with the secondary lock engagement surfaces 70 to prevent the movement of the terminal alignment member 14 from the first, protecting, pre-stage or shipping position to a second or fully inserted position.

In the first or protecting position, the alignment plate 14 is spaced from the terminal receiving portion 22 of the housing 12. This allows the alignment plate 14 to be positioned nearer to the free or mating ends 68 of the terminals 20 to provide structural support to the terminals 20 proximate their free or mating ends while still allowing a probe to access the terminals 20. In so doing, the alignment plate 14 provides protection to the free ends of the terminals 20, preventing the terminals 20 from being deformed or damaged prior to the insertion of the mating connector 18 into the shroud 24 of the housing 12. For example, the alignment plate 14 may shield the terminals 20 from objects that inadvertently enter the shroud 24. In some embodiments, the alignment plate 14 may align and/or hold the terminals 20 in designated positions to reduce the likelihood of stubbing during the mating operation. Optionally, the alignment plate 14 may be configured to function as a cover that reduces the likelihood of contaminants (e.g., dust) entering the shroud 24.

Referring to FIG. 4, the terminal alignment member 14 remains in the first, protecting, pre-stage or shipping position. However, the independent secondary lock member or movable member 16 is moved to a second or closed position in which the independent secondary lock member 16 engages the primary lock (not shown) and facilitates the securing of the terminals 20 in the housing 12. In various embodiments, the independent secondary lock member 16 cannot be fully moved to the second or closed position unless the terminals 20 are properly seated in the terminal receiving portion 22 of the housing 12.

The independent secondary lock member or movable member 16 is moved from the first or open position to the second or closed position by movement of the projection 52. As the projection 52 extends beyond the terminal receiving portion 22 and the plate portion 60 of the terminal alignment member 14, an operator can engage and move the projection 52 and the independent secondary lock member or movable member 16 from the first or open position to the second or closed position.

In this position, the terminal alignment plates or terminal alignment member engagement surfaces 50 is moved from the alignment plate receiving recesses 40. Consequently, the terminal alignment plates or terminal alignment member engagement surfaces 50 are no longer positioned in-line and or in engagement with the secondary lock engagement surfaces 70, allowing the movement of the terminal alignment member 14 from the first, protecting, pre-stage or shipping position to the second or fully inserted position, as shown in FIG. 5.

The movement of the terminal alignment member 14 from the first, protecting, pre-stage or shipping position to the second or fully inserted position is facilitated by the mating of the mating connector 18 with the connector assembly 10, as shown in FIGS. 6 and 7.

In the position shown in FIG. 6, the terminal alignment plates or terminal alignment member engagement surfaces 92 of the mating connector 18 are positioned in-line and in engagement with the mating connector engagement surfaces 80 of the terminal alignment member 14 to prevent the proper insertion of the mating connector 18 into the shroud 24 of the housing 12.

Referring to FIG. 7, the terminal alignment plates or terminal alignment member engagement surfaces 92 of the mating connector 18 is moved to a position in which the terminal alignment plates or terminal alignment member engagement surfaces 92 are no longer positioned in-line and or in engagement with the mating connector engagement surfaces 80, allowing the proper insertion of the mating connector 18 into the shroud 24 of the housing 12.

As described herein, the method of mating an electrical connector assembly 10 to a mating connector 18 includes: positioning the independent secondary locking member 16 in a first position; positioning the terminal alignment member 14 in a protecting position in which the secondary lock engagement surfaces 70 of the terminal alignment member 14 engage the terminal alignment plate engagement surfaces 50 of the independent secondary lock member 16, wherein the terminal alignment member 14 is prevented from being moved from the protecting position to a fully inserted position; moving the independent secondary locking member 16 to a second position in which the terminal alignment plate engagement surfaces 50 of the independent secondary lock member 16 do not engage the secondary lock engagement surfaces 70 of the terminal alignment member 14, allowing the terminal alignment member to be moved from the protecting position; and moving the terminal alignment member 14 to a fully inserted position.

The method may additionally include engaging a projection 52 of the independent secondary locking member 16 which extends through the terminal alignment member 14 to move the independent secondary locking member 16 from the first position to the second position.

The method may additionally include: positioning the mating connector 18 in line with the connector assembly 10; and preventing the insertion of the mating connector 18 into the connector assembly 10 when the mating connector 18 is not in condition for mating, wherein mating connector engaging surfaces 80 of the terminal alignment member 14 engage a portion of a mating connector 18 to prevent the insertion of the mating connector 18 into the electrical connector assembly 10.

While the invention has been described with reference to a preferred embodiment, it will be understood by those skilled in the art that various changes may be made and equivalents may be substituted for elements thereof without departing from the spirit and scope of the invention as defined in the accompanying claims. In particular, it will be clear to those skilled in the art that the present invention may be embodied in other specific forms, structures, arrangements, proportions, sizes, and with other elements, materials and components, without departing from the spirit or essential characteristics thereof. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. An electrical connector assembly comprising:

a housing having a plurality of terminals mounted in the housing with mating portions projecting therefrom;

a terminal alignment plate having a plurality of terminal alignment plate apertures for receiving the mating portions of the terminals, the terminal alignment plate having secondary lock engagement surfaces, the terminal alignment plate being movably mounted on the housing between a protecting position in which the terminal alignment plate is positioned proximate distal ends of the terminals and a fully inserted position in which the terminal alignment plate is positioned away from the distal ends of the terminals;

an independent secondary lock member, the independent secondary lock member having terminal alignment plate engagement surfaces, the independent secondary lock member being movably mounted on the housing between an open position and a closed position;

wherein when the independent secondary lock member is in the open position, the terminal alignment plate engagement surfaces engage the secondary lock engagement surfaces of the terminal alignment plate to retain the terminal alignment plate in the protecting position and prevent the terminal alignment plate from being moved to the fully inserted position;

wherein when the independent secondary lock member is in the closed position, the terminal alignment plate engagement surfaces do not engage the secondary lock engagement surfaces of the terminal alignment plate, allowing the terminal alignment plate to be moved to the fully inserted position.

2. The electrical connector assembly as recited in claim 1, wherein the secondary lock engagement surfaces extend from the terminal alignment plate and are positioned in recesses of a terminal receiving portion of the housing.

3. The electrical connector assembly as recited in claim 2, wherein the terminal alignment plate engagement surfaces extend from the independent secondary lock member and are positioned in the recesses of the terminal receiving portion of the housing.

4. The electrical connector assembly as recited in claim 1, wherein the independent secondary lock member has a projection which extends through the terminal alignment plate.

5. The electrical connector assembly as recited in claim 1, wherein the secondary lock engagement surfaces are provided on walls which extend from the terminal alignment plate.

6. The electrical connector assembly as recited in claim 5, wherein the walls which extend from the terminal alignment plate have slots provided therein for receiving guiding projections of the housing.

7. The electrical connector assembly as recited in claim 5, wherein the terminal alignment plate has mating connector engaging surfaces, the mating connector engaging surfaces engage a portion of a mating connector to prevent the insertion of the mating connector into the electrical connector assembly when the mating connector is not in condition for mating.

8. The electrical connector assembly as recited in claim 7, wherein the mating connector engaging surfaces provided on the walls which extend from the terminal alignment plate.

9. An electrical connector assembly comprising:

a housing having a plurality of terminals mounted in the housing with mating portions projecting therefrom, the housing having recesses for receiving portions of a terminal alignment member;

the terminal alignment member having a plurality of terminal alignment member apertures for receiving the mating portions of the terminals, the terminal alignment member having movable member engagement surfaces, the movable member engagement surfaces positioned in the recesses of the housing, the movable member engagement surfaces are provided on walls which extend approximately perpendicular from a terminal alignment plate of the terminal alignment member, portions of the walls are received in a recess of the housing, the walls have slots provided therein for receiving guiding projections of the housing, the terminal alignment member being movably mounted on the housing between a protecting position in which the terminal alignment member is positioned proximate distal ends of the terminals and a fully inserted position in which the terminal alignment member is positioned away from the distal ends of the terminals;

a movable member having terminal alignment member engagement surfaces, the movable member being movably mounted on the housing between a first position and a second position, the terminal alignment member engagement surfaces are positioned in the recesses of the housing when the movable member is in the first position, the terminal alignment member engagement surfaces are positioned outside of the recesses of the housing when the movable member is in the second position;

wherein when the movable member is in the first position, the terminal alignment member engagement surfaces engage the movable member engagement surfaces of the terminal alignment member to retain the terminal alignment member in the protecting position and prevent the terminal alignment member from being moved to the fully inserted position.

10. The electrical connector assembly as recited in claim 9, wherein the movable member has a projection which extends through the terminal alignment member.

11. The electrical connector assembly as recited in claim 10, wherein the movable member engagement surfaces extend from the terminal alignment member and are positioned in recesses of a terminal receiving portion of the housing.

12. The electrical connector assembly as recited in claim 11, wherein the terminal alignment member engagement surfaces extend from the movable member and are positioned in the recesses of the terminal receiving portion of the housing.

13. The electrical connector assembly as recited in claim 9, wherein the terminal alignment member has mating connector engaging surfaces, the mating connector engaging surfaces engage a portion of a mating connector to prevent the insertion of the mating connector into the electrical connector assembly when the mating connector is not in condition for mating.

14. The electrical connector assembly as recited in claim 13, wherein the mating connector engaging surfaces are provided on walls which extend approximately perpendicular from a terminal alignment plate of the terminal alignment member.

15. The electrical connector assembly as recited in claim 14, wherein the movable member is an independent secondary locking member.

16. A method of mating an electrical connector assembly to a mating connector, the method comprising:

positioning an independent secondary locking member in a first position;

positioning a terminal alignment member in a protecting position in which secondary lock engagement surfaces of the terminal alignment member engage terminal alignment plate engagement surfaces of the independent secondary lock member, wherein the terminal alignment member is prevented from being moved from the protecting position to a fully inserted position when the secondary locking member is in the first position;

moving the independent secondary locking member to a second position in which the terminal alignment plate engagement surfaces of the independent secondary lock member do not engage the secondary lock engagement surfaces of the terminal alignment member engage, allowing the terminal alignment member to be moved from the protecting position when the secondary locking member is in the second position;

moving the terminal alignment member to a fully inserted position.

17. The method as recited in claim 16, further comprising engaging a projection of the independent secondary locking member which extends through the terminal alignment member to move the independent secondary locking member from the first position to the second position.

18. The method as recited in claim 16, further comprising;

positioning the mating connector in line with the connector assembly;

preventing the insertion of the mating connector into the connector assembly when the mating connector is not in condition for mating, wherein mating connector engaging surfaces of the terminal alignment member engage a portion of a mating connector to prevent the insertion of the mating connector into the connector assembly.

* * * * *